US005146647A

United States Patent [19]

Blase et al.

[11] Patent Number: 5,146,647

[45] Date of Patent: Sep. 15, 1992

[54] CARPET EXTRACTOR WITH BUCKET CADDY

[75] Inventors: Michael R. Blase, Grand Rapids; Giovanni Pino, Kentwood; Kenneth E. Gibbs, Wyoming; Douglas C. Finn, Grand Rapids, all of Mich.

[73] Assignee: Bissell Inc., Grand Rapids, Mich.

[21] Appl. No.: 519,004

[22] Filed: May 4, 1990

[51] Int. Cl.[5] ..... A47L 5/36

[52] U.S. Cl. ..... 15/321; 15/353

[58] Field of Search ..... 15/321, 353

[56] References Cited

U.S. PATENT DOCUMENTS

| | | | |
|---|---|---|---|
| 2,198,322 | 4/1940 | Von Schrader | 15/321 X |
| 2,519,392 | 8/1950 | Minton | 146/2 |
| 2,739,003 | 3/1956 | Clarke | 292/247 |
| 2,777,142 | 1/1957 | Verde | 15/121.2 |
| 3,008,745 | 11/1961 | Cheney | 292/113 |
| 3,056,994 | 10/1962 | Noble | 15/321 |
| 3,117,337 | 1/1964 | Krammes | 15/320 |
| 3,321,230 | 5/1967 | Stollman | 292/113 |
| 3,527,269 | 9/1970 | Wilton | 141/364 |
| 3,527,270 | 9/1970 | Weil | 141/284 |
| 3,821,830 | 7/1974 | Sundheim | 15/321 |
| 3,896,521 | 7/1975 | Parise | 15/321 |
| 3,911,524 | 10/1975 | Parise | 15/353 |
| 4,068,340 | 1/1978 | Forward | 15/321 |
| 4,122,579 | 10/1978 | Parise | 15/353 |
| 4,200,951 | 5/1980 | Burgoon et al. | 15/321 |
| 4,216,563 | 8/1980 | Cyphert | 15/321 |
| 4,250,592 | 2/1981 | Emrick | 15/320 |
| 4,278,456 | 7/1981 | Hug | 55/429 |
| 4,287,635 | 9/1981 | Jacobs | 15/321 |
| 4,314,385 | 2/1982 | Wimsatt et al. | 15/321 |
| 4,320,555 | 3/1982 | Watson | 15/321 |
| 4,342,131 | 8/1982 | Reid | 15/327 |
| 4,484,773 | 11/1984 | Lehne | 292/263 |
| 4,656,700 | 4/1987 | Ahmed | 425/73 |
| 4,724,573 | 2/1988 | Ostergaard | 15/321 |
| 4,809,397 | 3/1989 | Jacobs et al. | 15/320 |
| 4,827,562 | 5/1989 | Blase et al. | 15/321 X |
| 4,864,680 | 9/1989 | Blase et al. | 15/321 |
| 4,934,017 | 6/1990 | Kent | 15/321 |

FOREIGN PATENT DOCUMENTS

| | | | |
|---|---|---|---|
| 176697 | 4/1986 | European Pat. Off. | 15/321 |
| 2572920 | 5/1986 | France | 15/321 |
| 7703126 | 9/1978 | Netherlands | 15/321 |
| 408132 | 9/1966 | Switzerland | 15/321 |

*Primary Examiner*—Chris K. Moore

*Attorney, Agent, or Firm*—Prince, Henveld, Cooper, DeWitt & Litton

[57] ABSTRACT

A liquid extraction surface cleaning apparatus having a cleaning solution tank and a recovery tank held in a floor-supported carriage with the tanks having sidewalls extending above the carriage. A housing which contains a suction fan, a suction chamber, a suction inlet connecting with the chamber and a water and air separator sits on top of the tanks with the suction chamber over the recovery tank. The housing is latched to the carriage capturing the tanks. A cleaning solution dispensing means extracts cleaning solution from the solution tank. Each tank has a pivotally connected handle and the cleaning solution tank has a chemical dispensing tray integral to its handle.

30 Claims, 5 Drawing Sheets

CARPET EXTRACTOR WITH BUCKET CADDY

BACKGROUND OF THE INVENTION

The present invention relates to surface cleaning apparatus and in particular to such apparatus that uses a liquid to clean carpet, upholstery and the like. Further, the present invention relates to devices such as cleaning solution buckets and latching devices, useful in such equipment. Such extractors are typically used with a cleaning solution which is dispensed to a carpet either from a tank in a floor unit of the extractor or from a hose connected to a faucet, having a siphoning device to siphon concentrated cleaner, typically from a bottle, into a stream of water at a predetermined ratio. After dispensing solution to the carpet, the solution and dirt from the carpet are vacuumed up with a floor tool, sucked through a vacuum hose to a floor unit and deposited in a recovery tank. After a period of use, the recovery tank has filled or overfilled and must be emptied. Typically, this is a cumbersome, awkward and messy task, often resulting in some spillage of dirty water.

The patent issued to Cyphert (U.S. Pat. No. 4,216,563) discloses a floor unit having a castered base housing a vacuum motor, a removable cleaning solution dispensing tank and a removable dirty water recovery tank. A power cord and a vacuum hose connect to the base unit. Each tank is a specially-molded, elongated container with one small access opening on its top, near one end. The cleaning solution tank contains a pump for dispensing cleaning solution. A hose, connected to the pump, extends from the tank to a floor tool used to dispense cleaning solution. A power cord also extends from the tank and plugs into a receptacle in the base unit to provide power for the pump. The pump adds to the weight of the tank and the dispensing hose and power cord can get in the way when the tank is removed from the base unit for filling or to discard excess solution. If the solution tank is not removed for filling, a bucket or hose would be used. Either way, spillage can occur on the plug connection for the pump, resulting in a short circuit or shock. The access opening in the recovery tank is relatively small and adjacent intake and exhaust plenums built into the end of the tank. Dirty water is likely to spill into one of the plenums when the tank is tipped to be emptied, causing a mess.

The patent to Wimsatt et al. (U.S. Pat. No. 4,314,385) discloses an extractor having a floor-supported housing on casters. The housing contains a vacuum motor and a cleaning solution pump. In operation, a recovery tank is assembled on top of the base unit and a cleaning solution bag is carried inside the housing. A solution pickup hose is connected to the pump and penetrates the wall of the solution bag. Solution from the bag is pumped through a dispensing hose, to a dispenser tool and onto the carpet. Using a bag for the cleaning solution has an inherent propensity for spillage and problems. The recovery tank is essentially a deep pot with a coaxial suction conduit piercing the bottom of the pot. A vacuum hose is connected on the side of the pot. Liquid can be drawn into the pot and flow into the suction conduit, flooding the vacuum blower and floor unit housing, giving rise to significant electrical shortage and shock hazard. The pot does not have a handle, making carrying and emptying difficult. Further, dirty water can spill through the vacuum hose connector when the pot is emptied, creating a mess.

The patent to Burgoon et al. (U.S. Pat. No. 4,200,951) discloses an extractor wherein the recovery tank sits within the cleaning solution tank. If the cleaning solution tank is filled without the recovery tank in place, the solution will overflow when the recovery tank is inserted. Further, when the recovery tank is removed, solution will drip from the exterior of the recovery tank. The recovery tank has no handle, making removal, carrying and emptying difficult.

The patent to Blase et al. (U.S. Pat. No. 4,864,680) discloses compact carpet extractor. This extractor has a lower, wheeled tank body and an upper housing, latched together with over center latches. This extractor uses the faucet connection method for dispensing cleaning solution. The lower tank portion is floor-supported and fitted with casters. The upper housing contains a vacuum motor and provides for power and vacuum hose connection. Incoming water and air enter an air and water separator chamber which opens into the lower tank. The suction means also opens directly into the lower tank.

Latching devices, such as an over center latch, often find use in such extractors as well as other items where one member is to be latched to another. A typical over center latch comprises four main parts: a base part, fastened to the first of two pieces to be latched together; a lever part, pivotally connected to the base; a clasping part, pivotally connected to the lever; and a hook provision on the second of the two items to be latched together. In operation, the clasping part engages the hook and the lever is manipulated to draw the hook and base together. Typically, the clasping part is riveted to the lever and the lever part is either riveted to the base or force-fit over projecting pins on the base, engaging apertures on the lever. Such latches are disclosed by the patents to Cheney (U.S. Pat. No. 3,008,745) and Stollman (U.S. Pat. No. 3,321,230). Riveting the parts together is time-consuming and results in a connection which is loose or does not pivot freely. Force-fitting the lever causes deformation and breakage.

SUMMARY OF THE INVENTION

The above shortcomings are resolved by the extractor of the present invention in which two open top buckets are removably held in a floor-supported carriage. A . vacuum motor, and preferably a solution pump, is mounted in a housing, removably seated over the buckets. The vacuum motor and a suction chamber are arranged in the housing such that dirt and liquid, vacuumed from a carpet, are deposited into one bucket. The pump is arranged such that cleaning solution is pumped out of the other bucket and dispensed t the carpet.

This arrangement allows the mechanical and electrical components of the extractor to be separated from the buckets. Each bucket is easily removable from the carriage, unencumbered by hoses, cords, added weight and other interference. Electrical shock hazard is eliminated, in part because liquid cannot fall up into the housing. Further, the housing can be removed and the buckets transported in the carriage for the convenience of the operator.

In another aspect of the invention, the cleaning solution bucket handle has an integral chemical tray which opens upwardly when the handle is laid flat and opens downwardly when the handle is pivoted upward. Thus, a chemical can be measured into the chemical tray when the handle is laid flat and dispensed into the solution bucket by lifting the handle upward.

In another aspect of the invention, the housing and carriage are latched together, capturing the buckets, by a unique over center latch. The latch comprises a hook on the housing, a base portion, snapped into the carriage, a lever portion, hingedly pinned together with the base, and a top clasping portion. The clasping portion has two legs which pivotally engage the lever portion and overlap the ends of the pivot pin, capturing the pin.

These and other advantages and features of the invention will become apparent upon review of the following specification in conjunction with the drawings.

DESCRIPTION OF THE PREFERRED EMBODIMENT

Figure 1:
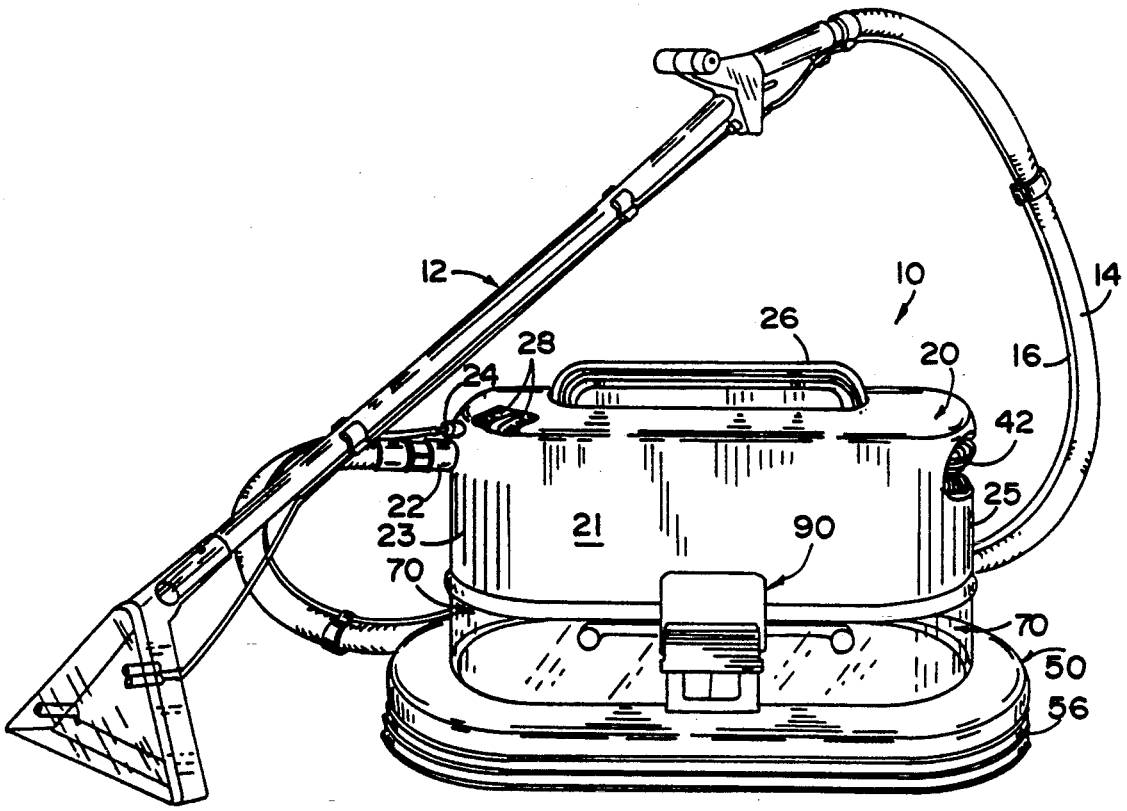
FIG. 1 is a perspective view of the extractor with a hose and a floor tool attached.
Figure 6:
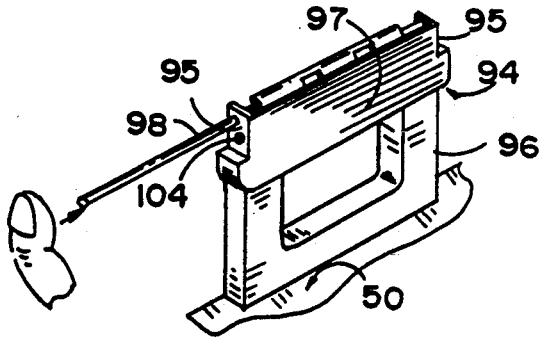
FIG. 6 is a perspective view of the hinge pin being inserted to assemble the base and lever parts of the latch used o the extractor of FIG. 1.

In the preferred embodiment, extractor 10 comprises a carriage 50 which removably carries a bucket 82 for cleaning solution and a bucket 72 for recovering dirty solution. An extractor vacuum motor 34, a fluid pump 38, a vacuum inlet 22 and a vacuum plenum 30 are located in a housing 20 which removably seats on top of buckets 72 and 82. Housing 20 is latched in place atop buckets 72 and 82 by latches 90 mounted on a carriage 50. Buckets 72 and 82 are thus sandwiched between housing 20 and carriage 50.

Figure 4:
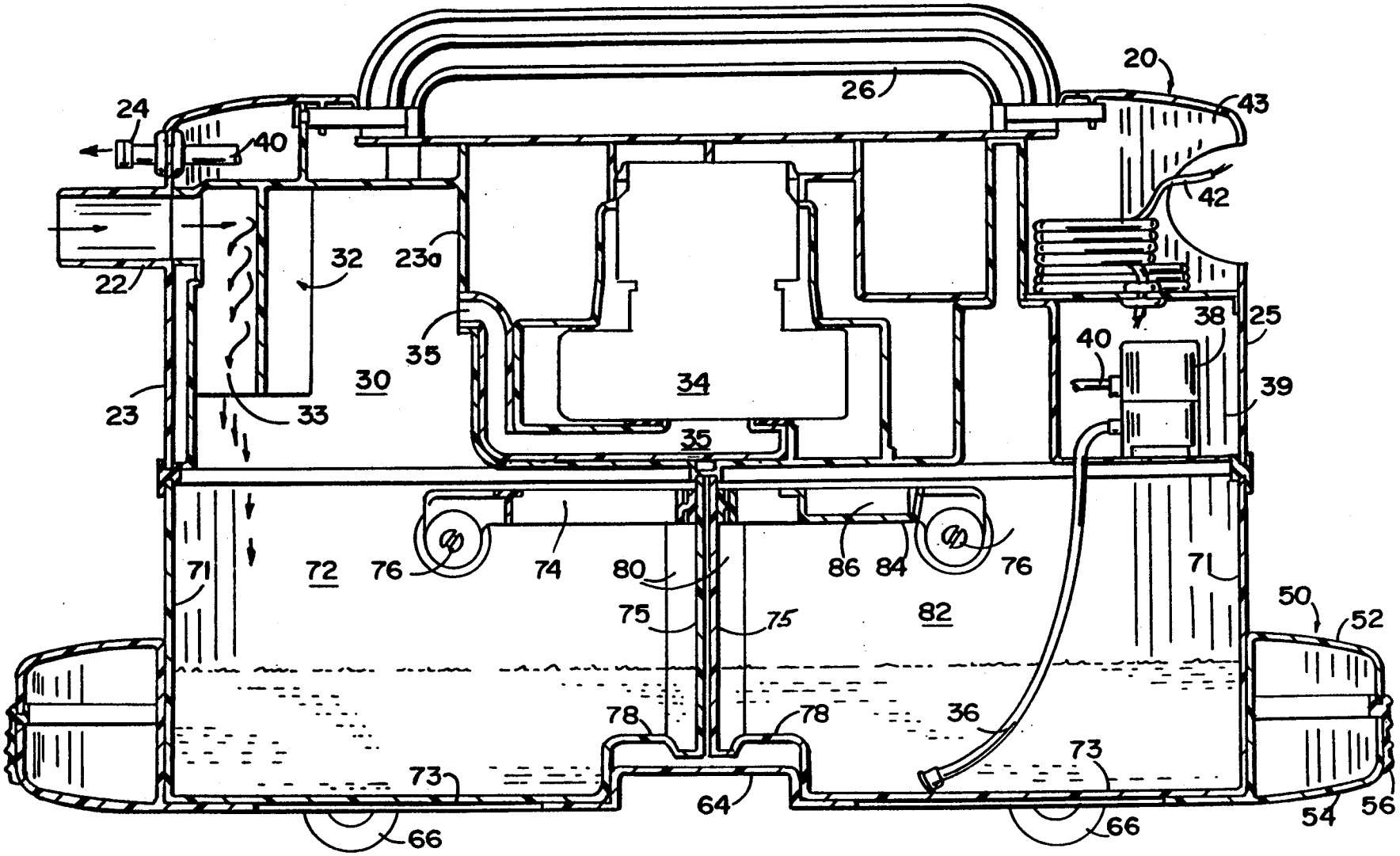
FIG. 4 is a longitudinal section view of the extractor of FIG. 1.

Plastic housing 20 has generally parallel, vertical sidewalls 21, joined by vertical end walls 23 and 25 which are semicircular in horizontal cross section. Sidewalls 21 and end walls 23 and 25 descend from a slightly domed top 29 with a recess 27 for a folding handle 26. As seen in FIG. 4, an end portion of housing 20 defines an open bottom vacuum plenum 30 circumscribed by housing end wall 23 and an interior vertical wall **23*a*. Plenum 30 seats over recovery bucket 72. Vacuum plenum 30 provides a chamber in which the energy of incoming air and water can be dissipated. Thus as with any plenum, plenum 30 has a cross section, lateral to the direction of suction flow, which is enlarged, relative to the lateral cross section of vacuum inlet 22. A vacuum hose connects to plenum 30 and bucket 72 via a vacuum hose connector 22. Plenum 30 also has a water and air separator baffle 32. Separator baffle 32 is a vertical plate descending from the top of housing 30 and extending in front of the opening from hose connector 22. Baffle 32 is curved about a vertical axis so a to be generally parallel to the curved end wall 23 of housing 20. The curvature of baffle 32 helps dissipate the energy of incoming foamed recovery water and separate air from water. An end wall 35 extends from each end of baffle 32 to end wall 23 of housing 20, forming separator chamber 33**.

A vacuum motor 34 in fluid communication with plenum 30 is mounted generally in the center of housing 20. A vacuum passage 35 extends from the inlet of vacuum motor 34 to an opening into vacuum plenum 30 through interior wall **23*a***.

A cleaning solution pick-up 36 is connected with a cleaning solution pump 38, mounted in an enclosed chamber 39 in the end of housing 20, adjacent end wall 25, opposite vacuum plenum 30. A hose 40 connects pump 38 with a cleaning solution hose connector 24, mounted on housing 20, near connector 22. A power cord 42 is connected to housing 20 and supplies power to pump 38 and motor 34 via control switches 28, shown in FIG. 1. Cord 42 is stored in a cord storage chamber 43, near pump 38. Housing 20 also features a latch hook 44 on each sidewall 21 near the middle thereof, FIG. 2.

Housing walls 21, 23 and 25 terminate in a bottom lip **20*a* which seats over the top edges of buckets 72 and 82. A central inverted sealing channel extends between sidewalls 21 near the center thereof and seats over the top edges of the facing flat vertical walls 75 of buckets 72 and 82**.

Figure 5:
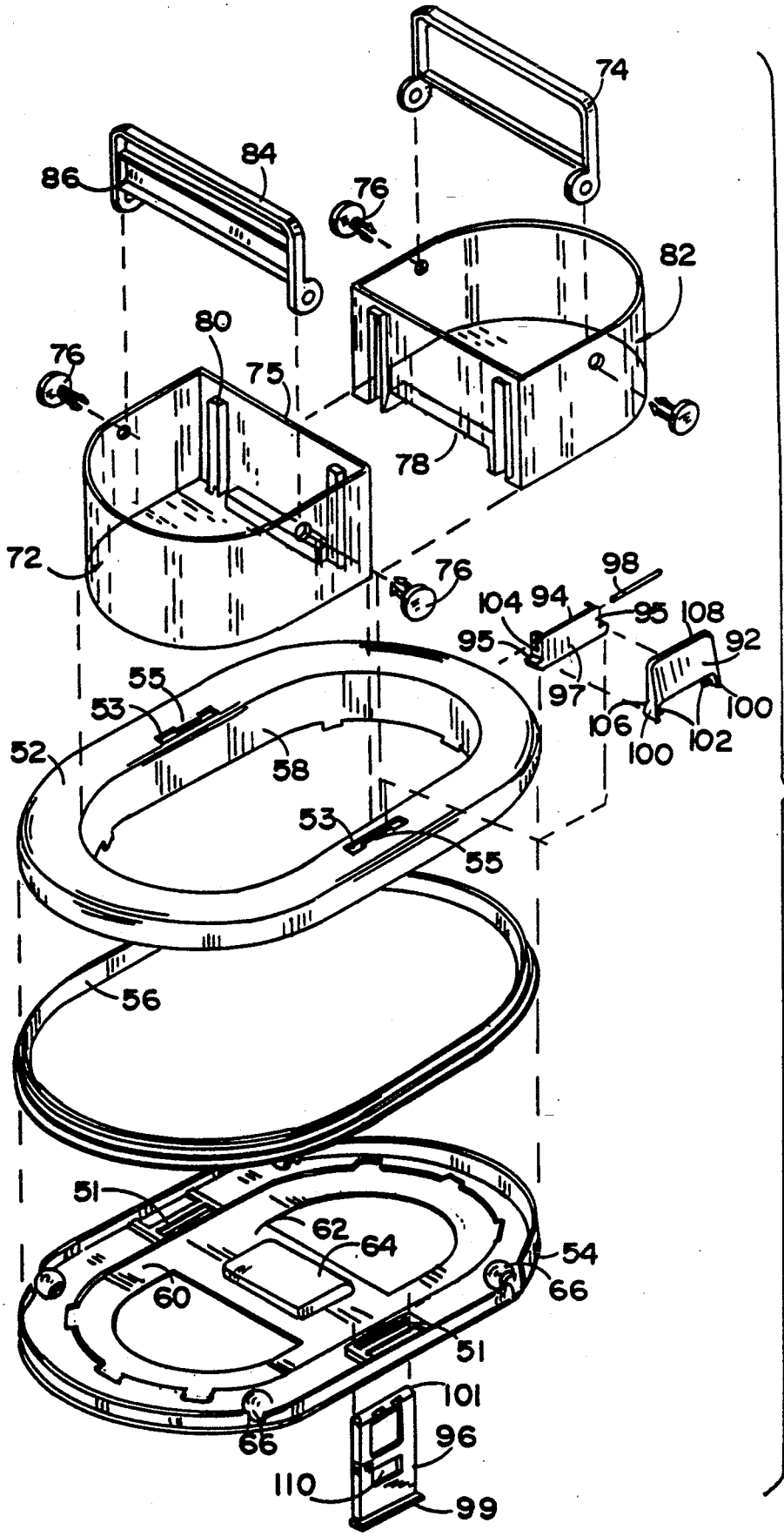
FIG. 5 is an exploded view of the carriage, the buckets and one latch of the extractor of FIG. 1.

Carriage 50 has an upper portion 52 and a lower portion 54, FIGS. 4 and 5, each of molded plastic. The upper and lower portions, 52 and 54, snap together to capture a rub strip 56 that circumscribes the perimeter of carriage 50. Upper portion 52 of carriage 50 has an elongated toroidal shape with a downwardly projecting inner wall 58. Lower portion 54 is of mating configuration and includes an inwardly projecting bottom rim 60 and a crosspiece 62 extending across the middle of lower portion 54 to define a partial floor for supporting buckets 72 and 82. Rim 60 projects inwardly beyond wall 58 such that wall 58, rim 60 and crosspiece 62 define an elongated, oval-shaped bucket receiving well 68, FIG. 3. Crosspiece 62 has a stiffening contour 64 in the preferred embodiment. Carriage 50 also features casters 66, mounted in the bottom of lower portion 54.

Buckets 72 and 82 are removably held in receiving well 68 of carriage 50. In the preferred embodiment, buckets 72 and 82 each have vertical sidewalls 71, flat bottom 73, a flat wall side 75, a hand grip 78 and handle rests 80, FIGS. 4 and 5. Buckets 72 and 82 are generally "D"-shaped in horizontal cross section such that the flat sidewalls 75 can be positioned closely adjacent one another in back-to-back relationship. Buckets 72 and 82 thus utilize their space in carriage 50 more efficiently.

Recovery bucket 72 has a hoop-style handle 74, fastened inside bucket 72 with plastic snap-in rivets 76. Handle 84 is likewise of the hoop style and includes integral chemical tray 86. Handle 84 is likewise fastened inside bucket 82 with rivets 76. Each handle folds flat inside each bucket, resting on rests 80 (FIGS. 4 and 5). Each hand grip 78 is a generally rectangular protrusion into bottom 73 and flat wall side 75 of the bucket. When a bucket is placed in carriage 50, contour 64 engages grip 78 and the bucket is properly positioned in the carriage, FIG. 4. Handle rests 80 are also a generally rectangular protrusion, protruding into the bucket near each end of flat wall side 75. Chemical tray 86 is a shallow tray extending between the opposite side legs of handle 84 so that the tray is generally contained within the plane of the handle. Tray 86 opens upwardly when handle 84 is in a horizontal position. When handle 84 is rotated upwardly, any chemicals in tray 84 empty out of it into bucket 82.

Figure 3:
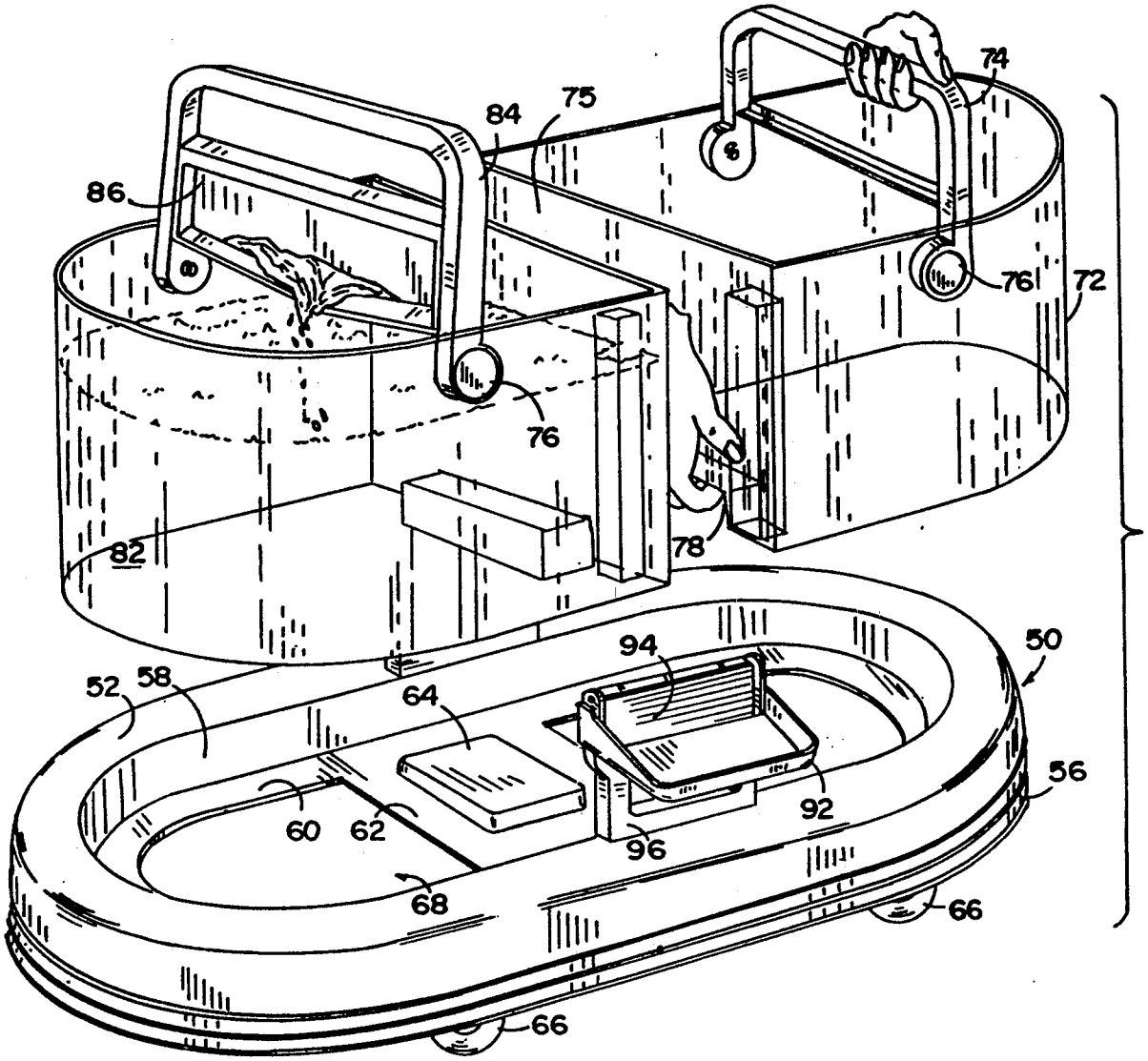
FIG. 3 is a perspective view of the buckets lifted above the carriage.

Buckets 72 and 82 are removably held in well 68 of carriage 50, FIG. 3. Housing 20 is seated upon sidewalls 71 of buckets 72 and 82 and is latched to carriage 50, capturing the buckets by two latches 90, FIG. 1. Each latch 90 has a base 96 with a flange 99, FIG. 5, circumscribing one end of base 96. Base 96 is connected to carriage 50 by inserting base 96 through mounting apertures 51 and 53 in carriage 50. Flange 99 acts as a stop when base 96 is inserted into carriage 50 and keeps base 96 from pulling through mounting apertures 51 and 53 in carriage 50 when latch 90 is closed. A recess 110 on the side of base 96 aligns with locking tab 55 in aperture 53 to lock base 96 into carriage 50. A sleeve 101 is provided at the other end of base 96 to receive a hinge pin 98.

A lever 94 is hingedly connected to base 96. Lever 94 is generally U-shaped with side flanges 95 and a connecting web 97. A hinge pin hole 105 is provided near the end of each flange 95. An aperture 104 is also provided in each flange 95, near hinge pin hole 105 and away from the end of the flange. Lever 94 is assembled to base 96 by aligning hinge pin holes 105 with sleeve 101 and inserting hinge pin 98 therethrouqh. Hinge pin 98 is slip-fit into hinge pin holes 105 and sleeve 101.

A clasp 92 is pivotally connected to lever 94. Clasp 92 is generally U-shaped with side legs 100 and a top web 108 closing the top end of U-shaped clasp 92. A sidewall 108*a* extends between legs 100 and descends from top web 108. Each leg 100 has a widened portion 106 near its lower end and a peg 102 protruding toward the opposing leg, near its lower end. Each peg 102 engages a corresponding aperture 104 on lever 94 and clasp 92 is pivotally connected to lever 94. Widened portion 106 of clasp 92 overlaps the ends of hinge pin 98 and captures the pin in place. Thus, base 96 is snapped into carriage 50, lever 94 is hingedly connected to base 96 and clasp 92 is pivotally connected to lever 94.

In use, a cleaning chemical concentrate is portioned into tray 86 in the horizontal position and dispensed into bucket 82 by pivoting handle 84 to the vertical position, FIG. 3. With its open top, solution bucket 82 is conveniently filled with water, typically by filling from a faucet, to mix a cleaning solution. Buckets 72 and 82 are positioned in receiving well 68 of carriage 50 with flat wall side 75 of one bucket adjacent to the flat wall side of the other bucket in back-to-back relationship. Each of the buckets 72 and 82 are positioned in are 68 of carriage 50. Housing 20 is positioned on top of buckets 72 and 82 such that pick-up 36 is inserted ,into bucket 82 and plenum 30 is positioned over bucket 72, FIG. 2. The clasping portion 92 of each latch 90 is manipulated upward to engage each latch hook 44 on the side of housing 20 and each lever 94 is manipulated downward to the closed position, latching housing 20 to carriage 50 and capturing buckets 72 and 82 therebetween. Vacuum hose 14 and solution supply hose 16, each connected at one end with a floor tool 12, are connected with connection 22 and connection 24, respectively, FIG. 1. Power cord 42 is plugged into a convenient power supply and control switches 28 are manipulated to turn on solution pump 38 and vacuum motor 34, FIG. 4.

Figure 2:
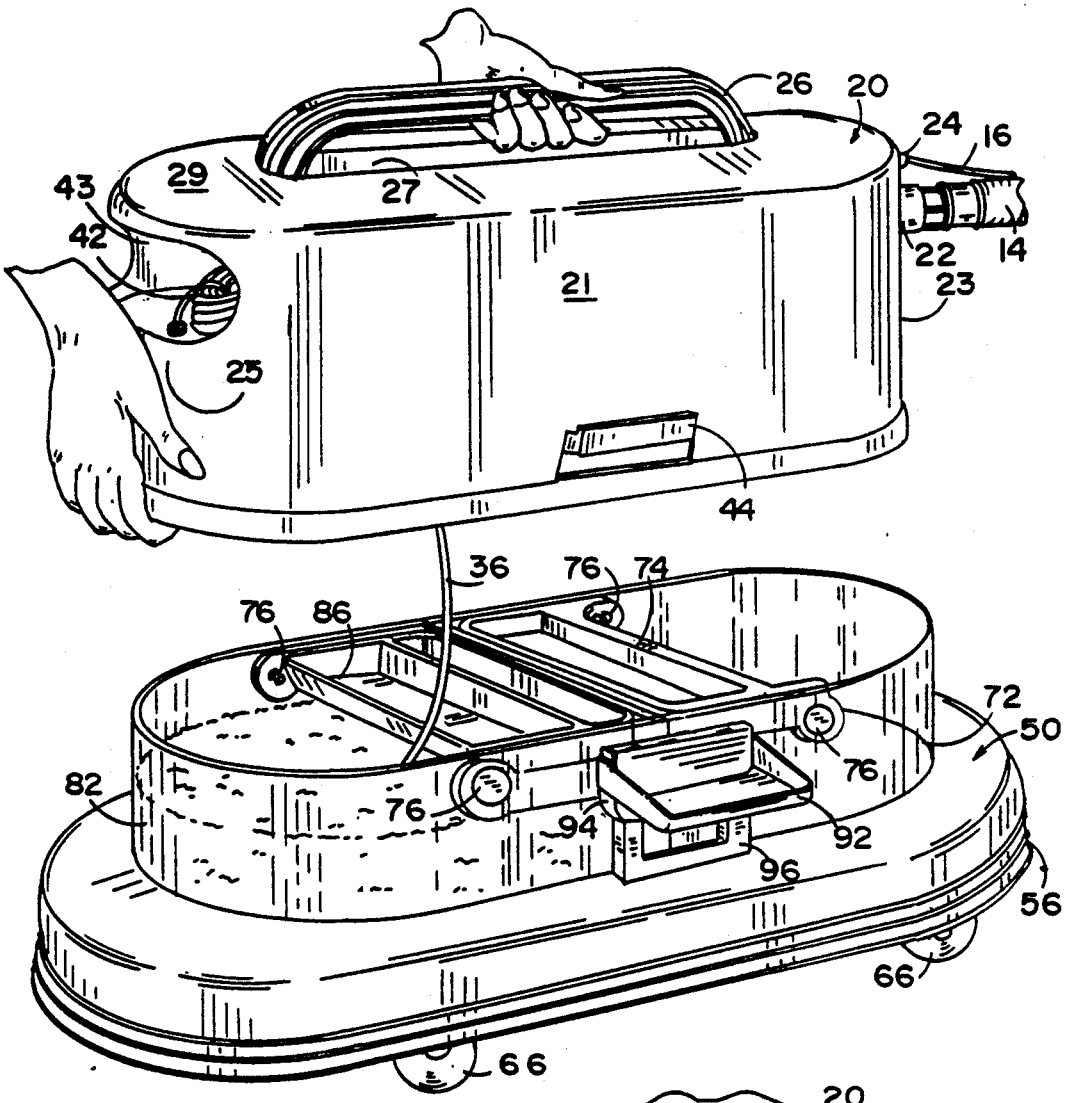
FIG. 2 is a perspective view of the extractor with the housing lifted above the buckets and carriage, showing the tops of the buckets.
Figure 7:
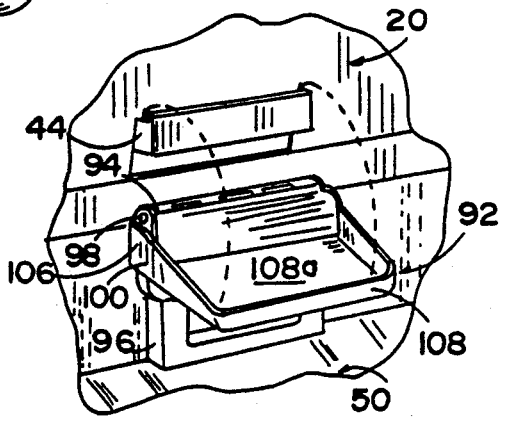
FIG. 7 is a perspective view of the latch used in the extractor of FIG. 1 in the open position.

The operator uses floor tool 12, FIG. 1, to dispense solution to a carpet and to vacuum solution and dirt from the carpet. Solution, dirt and air are sucked through vacuum hose 14, vacuum hose connector 22 and into separator chamber 32, FIG. 4. Dirt and water hit convex plate 33 and fall into recovery bucket 72. Air is sucked through separator chamber 32, into plenum 30 and exhausted by vacuum motor 34. As the cleaning operation continues, solution bucket 82 empties and recovery bucket 72 fills. The amount of dirty water received by recovery bucket 72 is limited by the amount of solution contained in solution bucket 82. Buckets 72 and 82 are the same size in the preferred embodiment, thus recovery bucket 72 will not overfill.

When recovery bucket 72 has filled, control switches 28, FIG. 1, are manipulated to turn off pump 38 and motor 34, FIG. 4. Lever 94 of each latch 90 is manipulated upward to open the latches, FIG. 2. Each clasp 92 is removed from each latch hook 44. Housing 20 is removed and set aside, exposing buckets 72 and 82. Recovery bucket 72 is easily removed and carried away via handle 74 for disposal of its contents, FIG. 3. By holding handle 74 with one hand and lifting at bucket grip 78 with the other hand, bucket 72 is easily emptied. Likewise, bucket 82 can be emptied of extra cleaning solution.

The above-described embodiment is merely a preferred embodiment of the invention. Changes and modifications in the specifically-described embodiment can be carried out without departing from the scope of the invention, which is intended to be limited only by the scope of the appended claims and all equivalents to which we are entitled as a matter of law.

The embodiments of the invention in which an exclusive property or privilege is claimed are defined as follows.

1. A liquid extraction surface cleaning apparatus comprising:

a floor-supported carriage for removably receiving and supporting two buckets;

two buckets removably located in said carriage independently of each other;

said carriage having a well in which said buckets are removably received;

said well including perimeter well wall portions which project upwardly a substantial portion of the height of said buckets and in close proximity to said buckets, to generally closely surround and embrace said buckets when they are seated in said well to prevent said buckets from tipping when said carriage is moved;

cleaning solution delivery means in fluid communication with one of said two buckets for drawing solution therefrom and conveying it to a dispensing tool;

a housing removably positioned upon said buckets and having a vacuum hose connection means in fluid communication with an opening in the bottom of said housing, said opening being positioned over the other of said two buckets such that liquid and solid debris drawn in through said vacuum hose connection means will be deposited into said other bucket; and suction means in said housing in fluid communication with said other bucket for drawing liquid and solid debris through said vacuum hose connection means and into said other bucket.

2. The apparatus of claim 1 wherein said well has a generally flat floor with a hole generally centered in each of two halves of said floor such that an inwardly projecting rim, around the perimeter of said well, is defined; and such that a crosspiece bisecting the bottom of said well is defined.

3. The apparatus of claim 1 wherein each of said two buckets has at least one flat, vertical side and wherein a vertical side of one bucket abuts a vertical side of the other bucket when held in said carriage.

4. The apparatus of claim 3 wherein each of said two buckets has a pivotable hoop handle which can be pivoted between a vertical position for carrying said bucket in a horizontal position.

5. A liquid extraction surface cleaning apparatus comprising:

a floor-supported carriage for removably receiving and supporting two buckets;

two buckets removably located in said carriage;

cleaning solution delivery means in fluid communication with one of said two buckets for drawing solution therefrom and conveying it to a dispensing tool;

a housing removably positioned upon said buckets and having a vacuum hose connection means in fluid communication with an opening in the bottom of said housing, said opening being positioned over the other of said two buckets such that liquid and solid debris drawn in through said vacuum hose connection means will be deposited into said other bucket;

suction means in said housing in fluid communication with said other bucket for drawing liquid and solid debris through said vacuum hose connection means and into said other bucket, said carriage having a well in which said buckets are removably received;

each of said two buckets having at least one flat, vertical side and wherein a vertical side of one bucket abuts a vertical side of the other bucket when held in said carriage;

each of said two buckets having a pivotable hoop handle which can be pivoted between a vertical position for carrying said bucket and a horizontal position; and at least one of said handles having an integral dispenser means for dispensing a chemical into said bucket.

6. The apparatus of claim 5 wherein said dispenser is a tray generally contained within the same plane as said handle, said tray being open upwardly to receive a cleaning chemical when said handle is horizontal and said tray being open downwardly to dispense said chemical into said bucket when said handle is vertical.

7. The apparatus of claim 1 wherein said cleaning solution delivery means is a pump mounted in said housing having a first conduit in fluid communication between said reservoir and said pump and having a second conduit in fluid communication between said pump and a dispensing tool such that cleaning solution is pumped from said reservoir and through said conduit to said dispensing tool.

8. A liquid extraction surface cleaning apparatus comprising:

a floor-supported carriage for removably receiving and supporting two buckets;

two buckets removably located in said carriage;

cleaning solution delivery means in fluid communication with one of said two buckets for drawing solution therefrom and conveying it to a dispensing tool;

a housing removably positioned upon said buckets and having a vacuum hose connection means in fluid communication with an opening in the bottom of said housing, said opening being positioned over the other of said two buckets such that liquid and solid debris drawn in through said vacuum hose connection means will be deposited into said other bucket;

suction means in said housing in fluid communication with said other bucket for drawing liquid and solid debris through said vacuum hose connection means and into said other bucket; and at least one latch on one of said carriage and said housing engaging a catch on the other of said carriage and said housing, for latching said housing to said carriage to thereby sandwich said buckets between said carriage and said housing.

9. The apparatus of claim 8 wherein said latch has:

an elongated base, said base having a first end with an aperture for receiving a hinge pin;

a hinge pin;

a lever having first and second edges and a first aperture near said first edge that aligns with said aperture in said base, said hinge pin being slip-fit into said first apertures such that said lever and said base are hingedly connected, said lever also having a second aperture near said first aperture and spaced away from said first edge relative to said first aperture;

a clasp having a first leg with first and second ends and a second leg spaced from said first leg with first and second ends, a web portion connected between said first ends of said legs, said first leg also having a stud connected near said second end and projecting toward said second leg and said second leg also having a stud connected near said second end and projecting toward said first leg, said first and second legs embracing said lever and said studs engaging the opposite ends of said second aperture in said lever to pivotally connect said clasp to said lever, said first and second legs overlapping and capturing said hinge pin in position in said first apertures in said lever and said bases:

said web of said clasp engaging said catch to secure said housing to said carriage and on top of said buckets.

10. The apparatus of claim 9 wherein said latch further includes said base having a second end with a flange circumscribing said second end and having a recessed side portion; said carriage having an aperture with a vertical axis for mounting said latch; said carriage having a locking tab projecting into said aperture to engage said recessed side portion and lock said base into said carriage, said first end of said base being inserted through said aperture, said flange abutting said carriage and said locking tab engaging said recessed side portion.

11. The apparatus of claim 1 wherein said carriage has a sufficiently low profile that said buckets have sidewalls that extend above said upwardly extending well walls of said carriage, such that said housing sits upon the top of said sidewalls.

12. A liquid extraction surface cleaning apparatus comprising:

a floor-supported carriage for removably receiving and supporting two buckets;

two buckets removably located in said carriage;

cleaning solution delivery means in fluid communication with one of said two buckets for drawing solution therefrom and conveying it to a dispensing tool;

a housing removably positioned upon said buckets and having a vacuum hose connection means in fluid communication with an opening in the bottom of said housing, said opening being positioned over the other of said two buckets such that liquid and solid debris drawn in through said vacuum hose connection means will be deposited into said other bucket;

suction means in said housing in fluid communication with said other bucket for drawing liquid and solid debris through said vacuum hose connection means and into said other bucket;

said carriage having a low profile and said buckets having sidewalls that extend above said carriage such that said housing sits upon the top of said sidewalls; and at least one latch for latching said housing to said carriage.

13. The apparatus of claim 12 wherein said latch has:

an elongated base, said base having a first end with an aperture for receiving a hinge pin;

a hinge pin;

a lever having first and second edges and a first aperture near said first edge that aligns with said aperture in said base, said hinge pin being slip-fit into said first apertures such that said lever and said base are hingedly connected, said lever also having a second aperture near said first aperture and spaced away from said first edge relative to said first aperture;

a clasp having a first leg with first and second ends and a second leg spaced from said first leg with first and second ends, a web portion connected between said first ends of said legs, said first leg also having a stud connected near said second end and projecting toward said second leg and said second leg also having a stud connected near said second end and projecting toward said first leg, said first and second legs embracing said lever and said studs engaging the opposite ends of said second aperture in said lever to pivotally connect said clasp to said lever, said first and second legs overlapping and capturing said hinge pin in position in said first apertures in said lever and said bases;

said web of said clasp engaging said catch to secure said housing to said carriage and on top of said buckets.

14. A liquid extraction surface cleaning apparatus comprising:

a floor-supported carriage for removably receiving and supporting two buckets;

two buckets removably located in said carriage;

cleaning solution delivery means in fluid communication with one of said two buckets for drawing solution therefrom and conveying it to a dispensing tool;

a housing removably positioned upon said buckets and having a vacuum hose connection means in fluid communication with an opening in the bottom of said housing, said opening being positioned over the other of said two buckets such that liquid and solid debris drawn in through said vacuum hose connection means will be deposited into said other bucket;

suction means in said housing in fluid communication with said other bucket for drawing liquid and solid debris through said vacuum hose connection means and into said other bucket; and at least one latch on one of said carriage and said housing engaging a catch on the other of said carriage to thereby sandwich said buckets between said carriage and said housing and wherein said carriage has a well in which said buckets are removably received; wherein each of said two buckets has at least one flat, vertical side and wherein a vertical side of one bucket abuts a vertical side of the other bucket when held in said carriage; and wherein said cleaning solution delivery means is a pump mounted in said housing having a first conduit in fluid communication between said reservoir and said pump and having a second conduit in fluid communication between said pump and said dispensing tool such that cleaning solution is pumped from said reservoir and through said conduit to a dispensing tool.

15. A liquid extraction surface cleaning apparatus comprising:

a floor-supported carriage for removably receiving and supporting two buckets;

two buckets removably located in said carriage;

cleaning solution delivery means in fluid communication with one of said two buckets for drawing solution therefrom and conveying it to a dispensing tool;

a housing removably positioned upon said buckets and having a vacuum hose connection means in fluid communication with an opening in the bottom of said housing, said opening being positioned over the other of said two buckets such that liquid and solid debris drawn in through said vacuum hose connection means will be deposited into said other bucket;

suction means in said housing in fluid communication with said other bucket for drawing liquid and solid debris through said vacuum hose connection means and into said other bucket;

said housing including a downwardly opening vacuum plenum, said vacuum hose connection means opening into said vacuum plenum at a first location, said housing including a suction passage extending from said suction means and opening into said vacuum plenum at a second location substantially spaced from said first location, and said vacuum plenum having a cross-sectional area between said first and second locations and transverse to an axis extending from said first to said second location, which is sufficiently greater than the lateral cross-sectional area of said vacuum hose, such that water drawn into said vacuum plenum through said vacuum connection means separates from the air moving with it and is not drawn into said suction passage; said vacuum plenum being located over and opening into said other bucket when said housing is positioned on said buckets, such that water which is separated from said air in said vacuum plenum descends into said other bucket.

16. The apparatus of claim 15 in which said housing includes an air and water separator baffle, located in said vacuum plenum at a point spaced from but in front of said vacuum hose connection means opening whereby air and water entering said vacuum plenum tend to engage said baffle and separate, allowing water to drain down into said other bucket.

17. A liquid extraction surface cleaning apparatus comprising:

a floor-supported carriage for removably receiving and supporting two buckets;

two buckets removably located in said carriage;

cleaning solution delivery means in fluid communication with one of said two buckets for drawing solution therefrom and conveying it to a dispensing tool;

a housing removably positioned upon said buckets and having a vacuum hose connection means in fluid communication with an opening in the bottom of said housing, said opening being positioned over the other of said two buckets such that liquid and solid debris drawn in through said vacuum hose connection means will be deposited into said other bucket;

suction means in said housing in fluid communication with said other bucket for drawing liquid and solid debris through said vacuum hose connection means and into said other bucket;

said housing including a downwardly opening vacuum plenum, said vacuum hose connection means opening into said vacuum plenum at a first location, said housing including a suction passage extending from said suction means and opening into said vacuum plenum at a location substantially spaced from said first point whereby water drawn into said vacuum plenum through said vacuum connection means is not drawn into said suction passage; said vacuum plenum being located over an opening into said other bucket when said housing is positioned on said buckets;

said housing including an air and water separator baffle, located in said vacuum plenum at a point spaced from but in front of said vacuum hose connection means opening whereby air and water entering said vacuum plenum tend to engage said baffle and separate, allowing water to drain down into said other bucket; and at least one latch on one of said carriage and said housing engaging a catch on the other of said carriage and said housing, for latching said housing to said carriage to thereby sandwich said buckets between said carriage and said housing.

18. The apparatus of claim 17 wherein said carriage has a well in which said buckets are removably received.

19. The apparatus of claim 18 wherein said carriage has a low profile and said buckets have sidewalls that extend above said carriage such that said housing sits upon the top of said sidewalls.

20. The apparatus of claim 19 wherein each of said two buckets has at least one flat, vertical side and wherein a vertical side of one bucket abuts a vertical side of the other bucket when held in said carriage.

21. The apparatus of claim 20 wherein each of said two buckets has a pivotable hoop handle which can be pivoted between a vertical position for carrying said bucket and a horizontal position; wherein at least one of said handles has an integral dispenser means for dispensing a chemical into said bucket; and wherein said dispenser is a tray generally contained within the same plane as said handle, said tray being open upwardly to receive a cleaning chemical when said handle is horizontal and said tray being open downwardly to dispense said chemical into said bucket when said handle is vertical.

22. The apparatus of claim 18 wherein said carriage has a low profile and said buckets have sidewalls that extend above said carriage such that said housing sits upon the top of said sidewalls.

23. The apparatus of claim 22 wherein each of said two buckets has at least one flat, vertical side and wherein a vertical side of one bucket abuts a vertical side of the other bucket when held in said carriage.

24. A liquid extraction surface cleaning apparatus comprising:

a floor-supported carriage for removably receiving and supporting two buckets;

two buckets removably located in said carriage;

cleaning solution delivery means in fluid communication with one of said two buckets for drawing solution therefrom and conveying it to a dispensing tool;

a housing removably positioned upon said buckets and having a vacuum hose connection means in fluid communication with an opening in the bottom of said housing, said opening being positioned over the other of said two buckets such that liquid and solid debris drawn in through said vacuum hose connection means will be deposited into said other bucket;

suction means in said housing in fluid communication with said other bucket for drawing liquid and solid debris through said vacuum hose connection means and into said other bucket;

said housing including a downwardly opening vacuum plenum, said vacuum hose connection means opening into said vacuum plenum at a first location, said housing including a suction passage extending from said suction means and opening into said vacuum plenum at a location substantially spaced from said first point whereby water drawn into said vacuum plenum through said vacuum connection means is not drawn into said suction passage; said vacuum plenum being located over an opening into said other bucket when said housing is positioned on said buckets; and including at least one latch on one of said carriage and said housing engaging a catch on the other of said carriage and said housing, for latching said housing to said carriage to thereby sandwich said buckets between said carriage and said housing.

25. The apparatus of claim 24 wherein said carriage has a well in which said buckets are removably received.

26. A liquid extraction surface cleaning apparatus comprising:

a floor supported carriage having a well for removably receiving and supporting a bucket, said carriage having a low profile and said bucket having sidewalls that extend above said carriage;

a bucket removably located in said well in said carriage;

a housing removably positioned upon said bucket and having a vacuum hose connection means in fluid communication with an opening in the bottom of said housing such that liquid and solids drawn through said hose connecting means will be deposited in said bucket;

suction means in said housing in fluid communication with said bucket for drawing liquid and solids through said vacuum hose connection means and into said bucket; and a latch on one of said carriage and said housing and a catch on the other of said carriage and said housing, said latch engaging said catch to secure said housing to said carriage with said bucket sandwiched therebetween.

27. The apparatus of claim 26 wherein said latch has:

an elongated base, said base having a first end with an aperture for receiving a hinge pin;

a hinge pin;

a lever having first and second edges and a first aperture near said first edge that aligns with said aperture in said base, said hinge pin being slip-fit into said first apertures such that said lever and said base are hingedly connected, said lever also having a second aperture near said first aperture and spaced away from said first edge relative to said first aperture;

a clasp having a first leg with first and second ends and a second leg spaced from said first leg with first and second ends, a web portion connected between said first ends of said legs, said first leg also having a stud connected near said second end and projecting toward said second leg and said second leg also having a stud connected near said second end and projecting toward said first leg, said first and second legs embracing said lever and said studs engaging the opposite ends of said second aperture in said lever to pivotally connect said clasp to said lever, said first and second legs overlapping and capturing said hinge pin in position in said first apertures in said lever and said bases:

said web of said clasp engaging said catch to secure said housing to said carriage and on top of said bucket.

28. The apparatus of claim 27 wherein said latch further includes said base having a second end with a flange circumscribing said second end and having a recessed side portion; said carriage having an aperture with a vertical axis for mounting said latch; said carriage having a locking tab projecting into said aperture to engage said recessed side portion and lock said base into said carriage, said first end of said base being inserted through said aperture, said flange abutting said carriage and said locking tab engaging said recessed side portion.

29. The apparatus of claim 26 in which said housing includes a downwardly opening vacuum plenum, said vacuum hose connection means opening into said vacuum plenum at a first location, said housing including a suction passage extending from said suction means and opening into said vacuum plenum at a point substantially spaced from said first point whereby water drawn into said vacuum plenum through said vacuum connection means is not drawn into said suction passage; said vacuum plenum being located over and opening into said bucket when said housing is positioned on said bucket.

30. The apparatus of claim 29 in which said housing includes an air and water separator baffle, located in said vacuum plenum at a point spaced from but in front of said vacuum hose connection means opening whereby air and water entering said vacuum plenum tend to engage said baffle and separate, allowing water to drain down into said bucket.

* * * * *

UNITED STATES PATENT AND TRADEMARK OFFICE

CERTIFICATE OF CORRECTION

PATENT NO. : 5,146,647

DATED : September 15, 1992

INVENTOR(S) : Blase et al.

It is certified that error appears in the above-identified patent and that said Letters Patent is hereby corrected as shown below:

On the title page, before item [57] Abstract, the Attorney, Agent, or Firm, "Prince" should be --Price--.
"Prince" should be --Price--.

Column 2, line 13;
After "discloses" insert --a--.

Column 2, line 54;
"dispensed t" should be --dispensed to--.

Column 3, line 31;
"used o" should be --used on--.

Column 3, line 66;
"so a" should be --so as--.

Column 5, line 49;
"are 68" should be --area 68--.

UNITED STATES PATENT AND TRADEMARK OFFICE

CERTIFICATE OF CORRECTION

PATENT NO. : 5,146,647

DATED : September 15, 1992

INVENTOR(S) : Blase et al.

It is certified that error appears in the above-identified patent and that said Letters Patent is hereby corrected as shown below:

Column 5, line 51;
",into" should be --into--.

Column 10, line 6, claim 14;
After "carriage" insert --and said housing for latching said housing to said carriage--.

Signed and Sealed this

Ninth Day of November, 1993

Bruce Lehman

*Attest:*

BRUCE LEHMAN

*Attesting Officer*

*Commissioner of Patents and Trademarks*